US009363611B2

(12) United States Patent
Thigpen

(10) Patent No.: US 9,363,611 B2
(45) Date of Patent: Jun. 7, 2016

(54) ROTARY TRANSDUCER WITH IMPROVED HIGH FREQUENCY OUTPUT

(71) Applicant: F. Bruce Thigpen, Tallahassee, FL (US)

(72) Inventor: F. Bruce Thigpen, Tallahassee, FL (US)

( * ) Notice: Subject to any disclaimer, the term of this patent is extended or adjusted under 35 U.S.C. 154(b) by 29 days.

(21) Appl. No.: 14/515,846

(22) Filed: Oct. 16, 2014

(65) Prior Publication Data

US 2016/0112810 A1 Apr. 21, 2016

(51) Int. Cl.
*H04R 1/10* (2006.01)
*H04R 23/00* (2006.01)

(52) U.S. Cl.
CPC ..... *H04R 23/00* (2013.01)

(58) Field of Classification Search
CPC ..... H04R 1/10; H04R 1/42; H04R 1/02; H04R 1/025; H04R 1/026; H04R 9/00
USPC ..... 381/161–166, 395, 396
See application file for complete search history.

(56) References Cited

U.S. PATENT DOCUMENTS 2,304,022 A * 12/1942 Sanders, Jr. ..... H04R 23/00 381/165
4,763,358 A * 8/1988 Danley ..... H04R 23/00 381/165
5,191,618 A * 3/1993 Hisey ..... H02K 26/00 381/165
8,965,024 B2 * 2/2015 Graham ..... H04R 9/06 381/165

* cited by examiner

*Primary Examiner* — Suhan Ni
(74) *Attorney, Agent, or Firm* — J. Wiley Horton

(57) ABSTRACT

A rotary sound transducer having an improved output at higher frequencies. The invention includes stiff vanes that are preferably rigidly attached to a hub. A torsional actuator is provided in each vane. The torsional actuator selectively twists the tip portion of each vane. The torsional actuator for each vane is activated by an input energy source corresponding to the sound waves that are desired. The input force may also be electromechanical energy, purely mechanical energy, or some other form of energy.

20 Claims, 19 Drawing Sheets

ROTARY TRANSDUCER WITH IMPROVED HIGH FREQUENCY OUTPUT

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of sound generation and modification. More specifically, the invention comprises a rotary transducer where the pitch of rotating vanes is used to create or modify pressure waves. The invention includes additional features to increase the output of the transducer in the upper portion of its frequency response range.

2. Description of the Related Art

Rotary sound transducers convert non-acoustic input energy into acoustic output energy by varying the pitch of rotating vanes. The vanes typically rotate in a fixed arc around a hub. The pitch of the vanes is varied as they rotate in order to create the acoustic output energy. One example of such a device is disclosed in U.S. Pat. No. 2,304,022 to Sanders (1942) (hereinafter "Sanders"). Sanders discloses a sound producing apparatus that resembles an electric fan. Cyclical electrical energy is fed into an electromagnet in the invention's hub. The input energy cyclically varies the pitch of the vanes—thereby producing sound waves at a desired frequency.

Another type of rotary transducer is disclosed in my own prior patent application (U.S. patent application Ser. No. 10/442,852). My prior application uses a swash plate to vary the pitch of the rotating vanes in a manner reminiscent of the mechanism used to vary the pitch of a helicopter's main rotor. FIGS. 1-3 refer to my prior design.

FIG. 1 shows the main components of the prior art rotary transducer. A pair of vanes is driven in the arc shown by shaft 30. A motor within housing 26 spins shaft 30. Swash plate 36 actuates two linkages 40 connected to a pitch-actuating mechanism on each vane. The reader will observe that moving the linkages will cause the deflection of the two vanes 34 so that the angle of attack of each vane (relative to the air flowing over its leading edge) is increased or decreased. The angle of attack of the two vanes is changed in unison.

Swash plate 36 translates in a direction that is parallel to the central axis of shaft 30. The swash plate is urged toward the vanes or away from the vanes by the motion of voice coil 20. Voice coil 20 is an electromagnetic device such as used in a common audio speaker. The voice coil is suspended in a neutral position by suspension spider 22 (which is also commonly used in audio speakers) or held in the neutral place by the influence of the air load on the leading and trailing edges of the vanes. Wire bundle 42 includes the wires used to provide electrical power to the motor that rotates the vanes and other wires used to provide the input for the motion of the voice coil.

FIG. 2 shows a sectional view through the prior art device with the vanes in the "neutral" position. In this position the vanes have a zero angle of attack and no pressure waves are produced (other than a small cyclical output caused by the flat vanes "cutting" through the air). Motor 28 provides the driving torque for shaft 30. Voice coil assembly 12 includes the components that move the swash plate. Magnet 18 is held between back plate 14 and front plate 16. Voice coil 20 moves linearly (left and right in the orientation of the view) as a magnetic field is applied by center pole assembly 24 under the influence of magnet 18.

Conventional rotary bearings 32 support the rotating shaft. Bearing assembly 38 is a thrust-type bearing. It allows swash plate 36 to rotate with respect to voice coil 20 while also transmitting a linear force. Although the mechanism shown is reminiscent of that used in a helicopter's main rotor, the reader will note that the pitch of the two vanes is not varied independently but always in unison. Thus, using helicopter terminology, the simple swash plate is able to vary the "collective" pitch but is unable to create cyclical variations customarily produced by tilting the swash plate in a helicopter.

FIG. 3 shows the same mechanism with voice coil 20 pushed away from the neutral position by the application of electromagnetic force. The voice coil and swash plate have been urged to the left in the orientation of FIG. 3. Thus, the two linkages 40 have also been pushed away from the neutral position and the two vanes 34 have been pitched as shown (in opposite directions). The result is that the vanes are given a substantial angle of attack.

A transducer such as shown in FIGS. 1-3 is able to produce low frequency sound waves without requiring a large and heavy conventional transducer. The shaft rotates the assembly at a speed which is often much higher than the frequency of the desired sound waves. As an example, the shaft might be rotated between about 600 and 1000 RPM, while the transducer might be used to generate sound waves in the range of 20 Hz to 100 Hz. Sound in this range may be effectively produced using a rotary transducer having an overall diameter of about 8 inches. In contrast, a 15 inch to 18 inch cone speaker will often be needed to produce a 20 Hz output. An enclosure for such a speaker will add considerable bulk and mass as well.

By virtue of the rotational speed of the blades and the swept air of the blades for each cycle at very low frequencies the rotary transducer offers a significant impedance match advantage with air or fluids in comparison to a moving cone or piston.

The rotary design can be used in an enclosure or box where the back wave pressure is captured and the transducer becomes a monopole. Because the rotary design has a significantly improved impedance match with the air, it can also be used as a dipole for low frequency sound reproduction.

Of course, when operated as a dipole, air within the positive pressure generated on one side of the plane of rotation has an easy path of travel to the negative pressure on the opposite side of the plane of rotation. This forms a sort of "short circuit" for dipole operations. The effect of the "short circuit" in dipole operation varies with frequency. The transducer is generally rotated at a relatively constant speed. Thus, the "swept area" of the vanes is constant. For low frequency inputs, the output amplitude is good. A significant amplitude "roll off" is experienced for higher frequencies, however.

At extremely low frequencies one can achieve one or more full revolutions of the drive shaft per pitch cycle of the vanes. As the input frequency is reduced, the impedance match with the air improves due to the increase in swept area. Conversely, at higher frequencies the swept area is reduced in comparison to the rotational velocity and each pitch cycle or oscillation may only consume a small portion of a full revolution of the drive shaft. This reduction in effective area and shorter wavelengths result in a 12 dB per octave decrease in output amplitude for increasing input frequency with the prior art construction.

The "roll off" with increasing frequency is exactly the opposite of what occurs with a conventional cone-type loudspeaker. Such speakers are driven by a linear actuator (a voice coil) connected to a cone or "piston". As the input frequency to the voice coil increases, the wavelengths decrease relative to the physical dimensions of the piston and the impedance match with the air becomes more favorable. Since the wavelength of sound decreases with increasing frequency and the net radiating area of the piston is constant, the impedance match of the cone with the air is improved.

Two factors dictate the "roll off" a rotary vane transducer experiences with increasing input frequency. The first factor is loss of the impedance match with the air as the frequency is increased. The second factor is the inertia of the actuating mechanism and the vanes themselves which requires more force from the actuator to maintain the same acoustic output. It is therefore desirable to produce a rotary transducer that retains the ability to produce low frequency sound while reducing the "roll off" phenomenon inherent in the prior art devices.

BRIEF SUMMARY OF THE INVENTION

The present invention comprises a rotary sound transducer having an improved output at higher frequencies. The invention includes stiff vanes that are preferably rigidly attached to a hub. A torsional actuator is provided in each vane. The torsional actuator selectively twists the outer portion of each vane. The torsional actuator for each vane is activated by an input energy source corresponding to the sound waves that are desired. For example, the input energy source may be hydraulic pressure varied at 100 Hz. The input force may also be electromechanical energy, purely mechanical energy, or some other form of energy.

The torsional actuator tends to vary the pitch of the outer portion of each vane significantly more than the root portion. The outer portion travels through a greater arc length per revolution of the transducer than the root portion. Thus, the angular deflection is provided where the swept area and velocity is greatest. This fact increases the transducer's output. In addition, since only a portion of the vane is being twisted, inertial effects are minimized and a torsional natural frequency results. This allows the restoring force (primarily vane stiffness but possibly other restoring forces as well) to rapidly restore the untwisted state and the blade becomes easier to pitch at frequencies near the torsional natural frequency. This fact means that higher input frequencies may be converted to sound by the transducer without losing significant amplitude.

REFERENCE NUMERALS IN THE DRAWINGS

Figure 1:
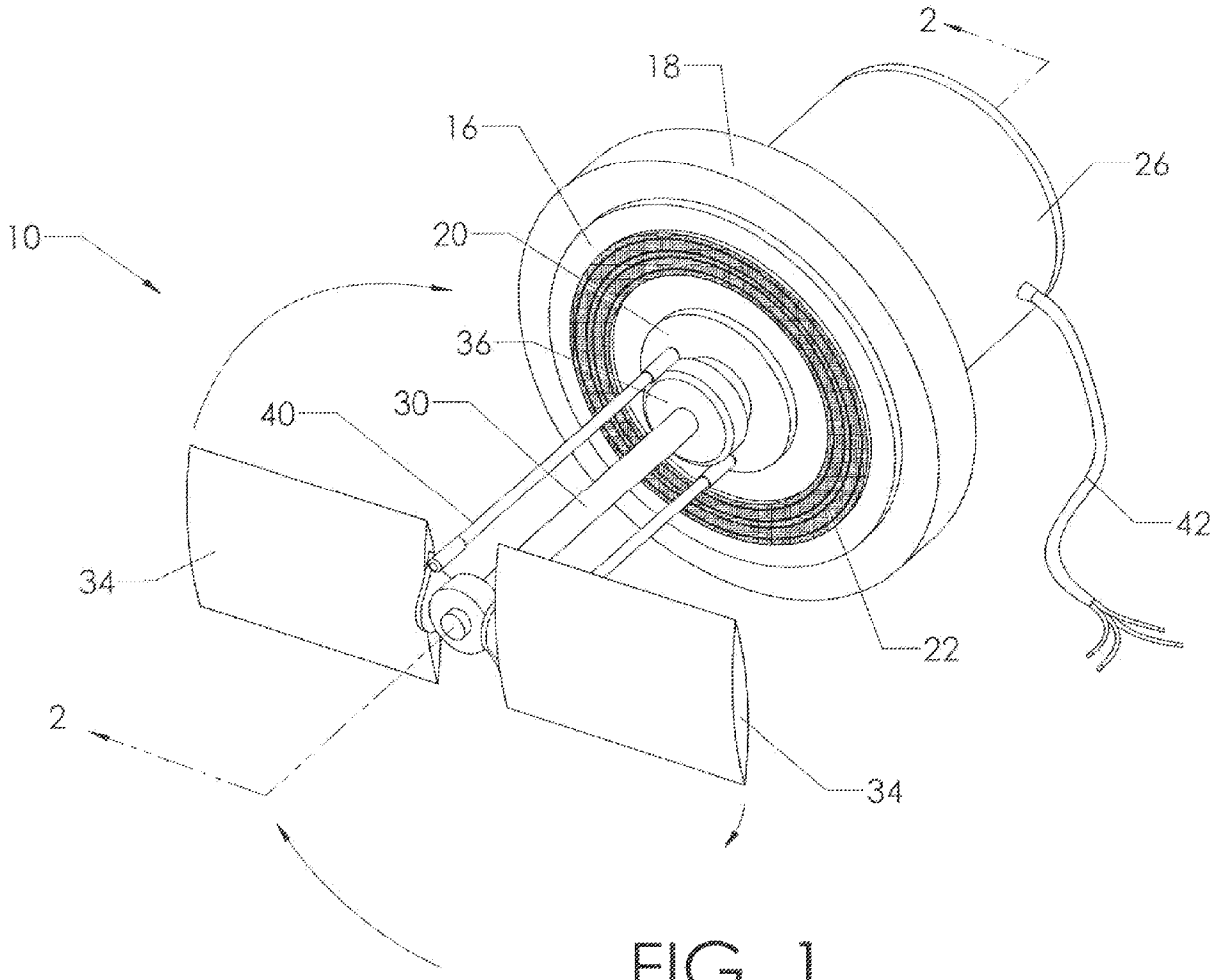
FIG. 1 (PRIOR ART)
FIG. 1 is a perspective view, showing a prior art rotary transducer.
Figure 2:
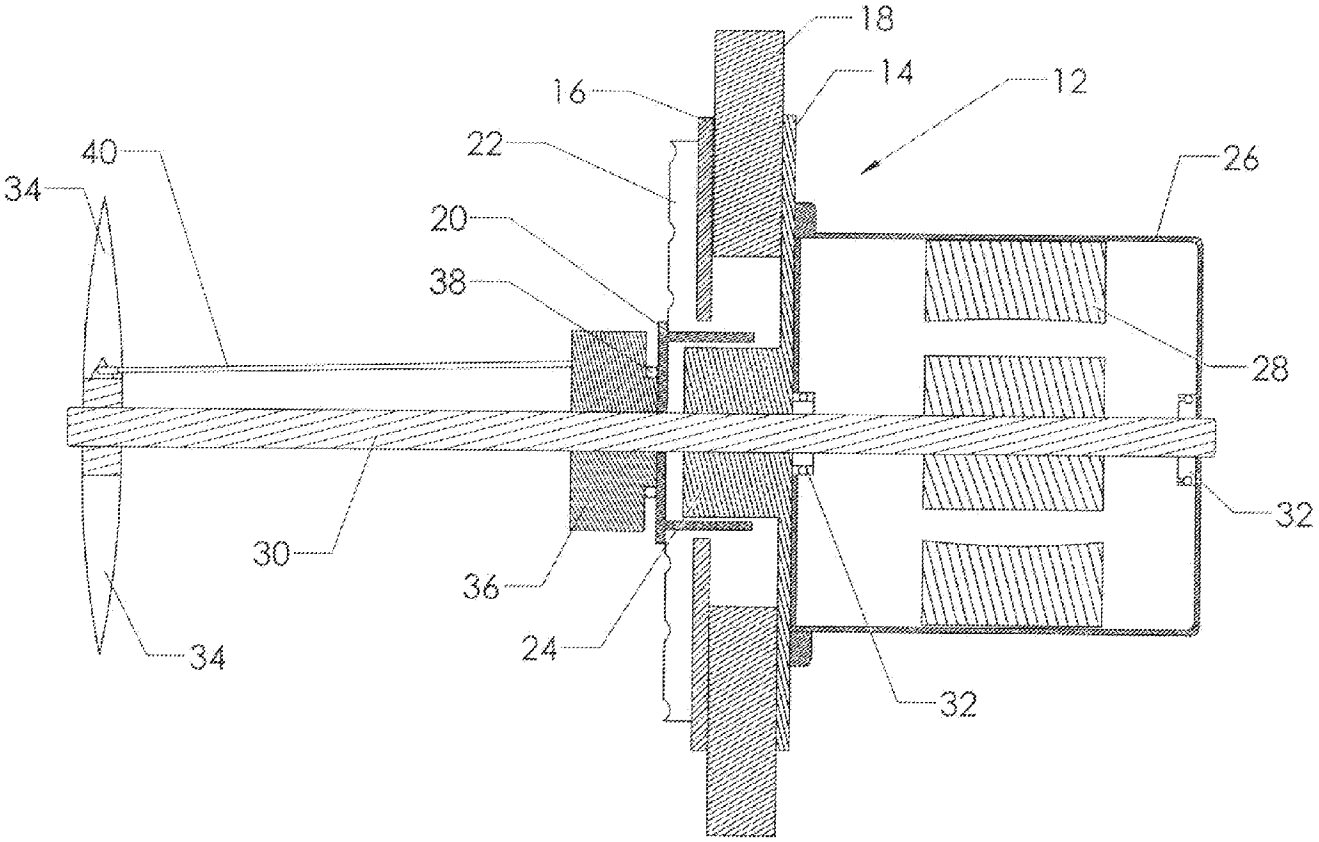
FIG. 2 (PRIOR ART)
FIG. 2 is a sectional elevation view, showing some internal details of the prior art rotary transducer.
Figure 3:
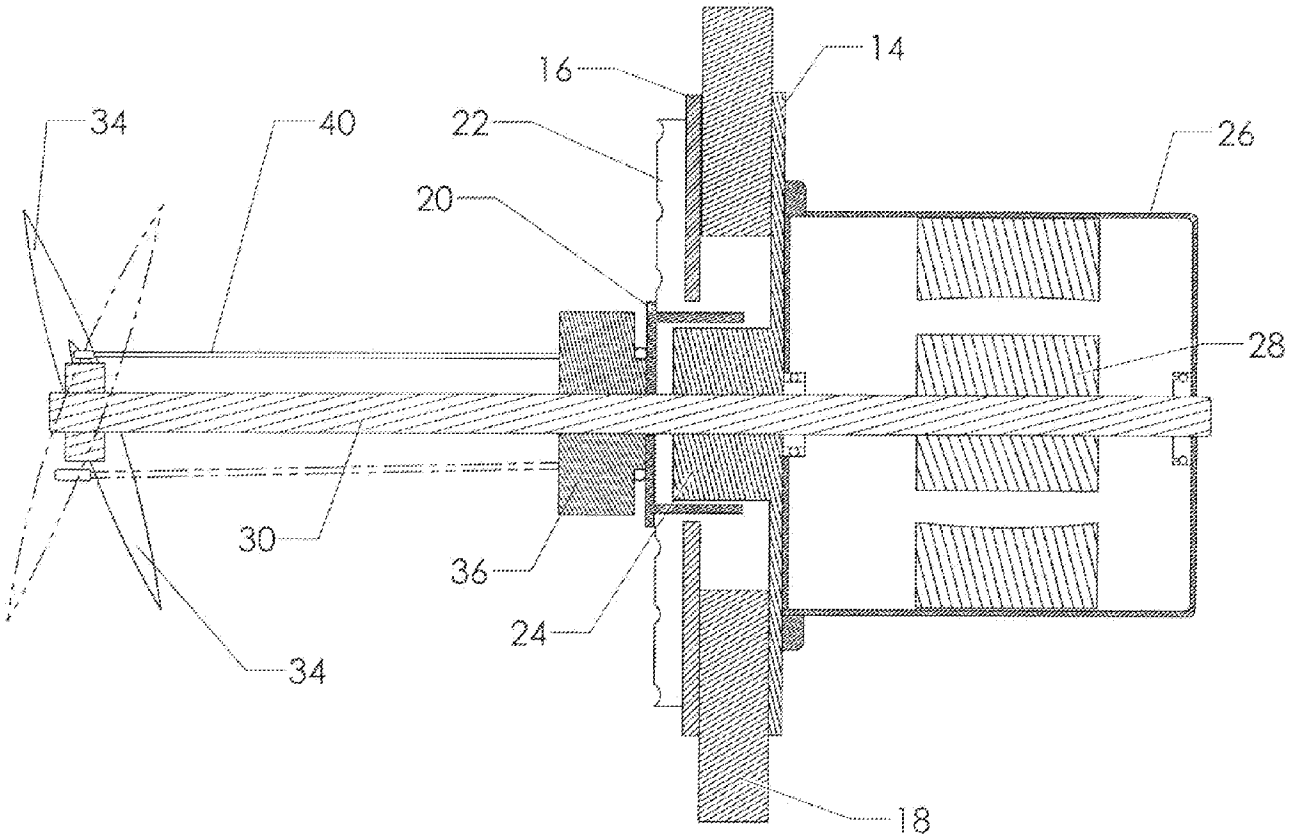
FIG. 3 (PRIOR ART)
FIG. 3 is a sectional elevation view, showing the transducer of FIG. 2 with the vane pitch mechanism activated.

10 rotary transducer
12 voice coil assembly
14 back plate
16 front plate
18 magnet
20 voice coil
22 suspension spider
24 center pole assembly
26 housing
28 motor
30 shaft
32 bearing
34 vane
36 swash plate
38 bearing assembly
40 linkage
42 wire bundle
44 tip
46 root
48 leading edge
50 trailing edge
52 hub interface
54 mounting hole
56 torsion rod
58 sleeve
60 hub bearing
62 pitch arm
64 rod receiver
66 rod tip
68 variable pitch region
70 middle region
72 hub assembly
74 drive shaft
76 center disk
78 bolt

80 actuator pin
82 center bore
84 actuator plate
86 actuator shaft
88 magnet
90 electromechanical actuator

DETAILED DESCRIPTION OF THE INVENTION

The present invention uses two or more relatively stiff vanes fixedly attached to a rotating hub. The pitch of the vanes is varied cyclically in order to produce a desired sound. The pitch variation needed is actually created by twisting the vane. Once the twisting force is relaxed, the natural stiffness of the vane and aerodynamic force tends to return it to its neutral position (possibly assisted by other restoring forces). By creating the vane with a stiff structure, high frequency pitch variations are possible.

Figure 4:
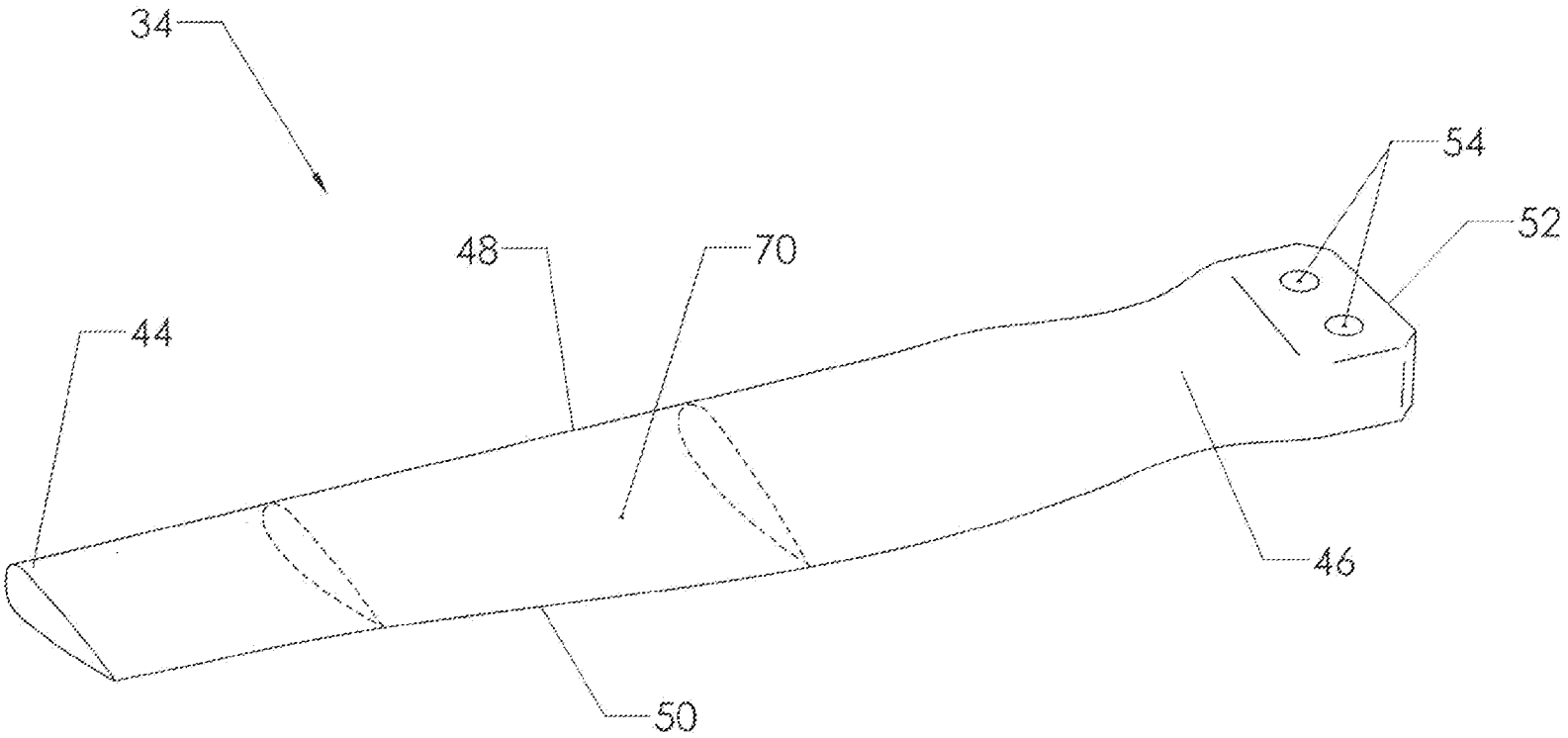
FIG. 4 is a perspective view, showing a vane used in the present invention.

FIG. 4 shows one example of a vane 34 suitable for use in the present invention. Hub interface 52 is configured to mount to a rotating hub—in this case using a pair of bolts passed through mounting holes 54. Root 46 extends outward from the hub interface and blends into middle region 70. Tip 44 lies at the vane's distal extreme. Leading edge 48 lies in the direction of rotation while trailing edge 50 lies in the opposite direction.

The shape of vane 34 in this example is similar to that used for an aircraft propeller. The reader will note that the angle of attack decreases as one proceeds from root 46 out toward tip 44 (two representative cross sections are shown as dashed lines). This variation in the angle of attack compensates for the fact that the tip travels further per revolution of the vane than the root. FIG. 4 actually shows the "relaxed" or "neutral" position for this particular vane, which is defined as the state of the vane when no external twisting forces are applied. The reader will note that the "neutral" position in this embodiment still retains a non-zero angle of attack. This need not always be the case. However, for the example shown, the "neutral" position generates thrust as the vane is rotated.

Figure 5:
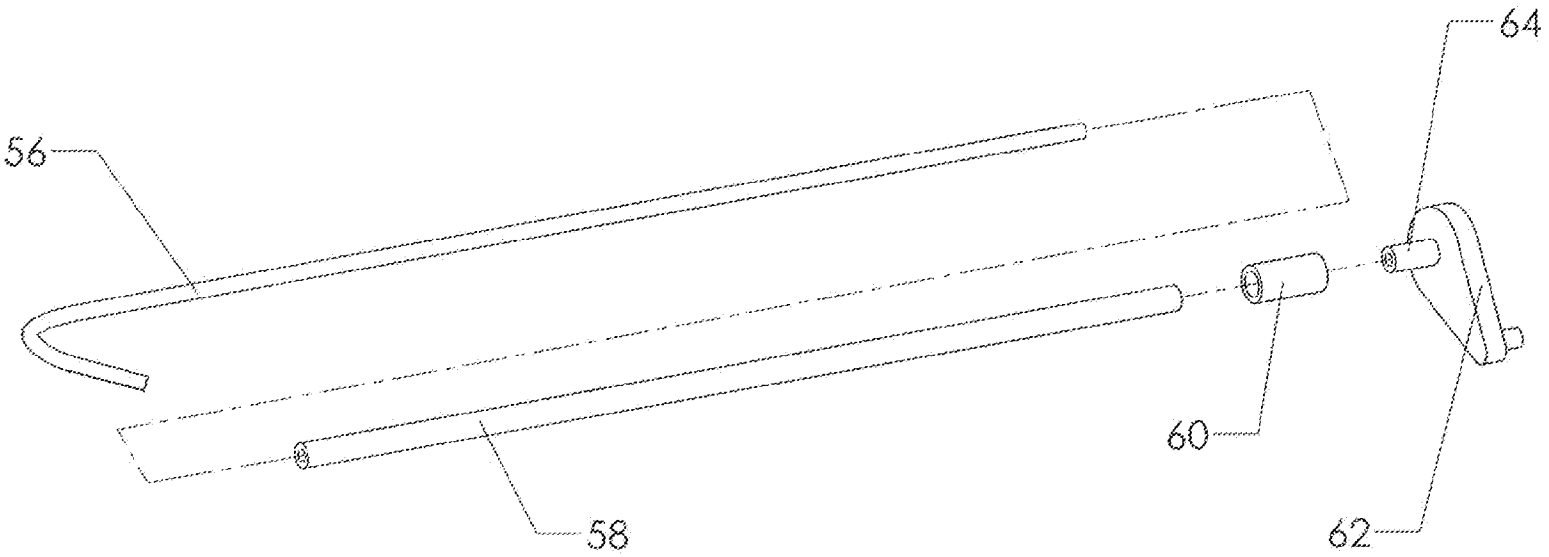
FIG. 5 is an exploded perspective view, showing the components of a torsional actuator as used in the present invention.

A torsional actuator is added to the vane to drive the desired pitch variations. FIGS. 5-8 illustrate an exemplary embodiment for such a torsional actuator. FIG. 5 presents an exploded perspective view showing the components employed. Torsion rod 56 is a long metal rod with a bent portion lying at is distal end. Sleeve 58 slips over most of the length of torsion rod 56. Hub bearing 60 slips over the proximal end of the rod. Rod receiver 64 is designed to receiver and lock to the proximal portion of torsion rod 56. Rotation is prevented between the rod receiver and the torsion rod. In this example, pitch arm 62 is formed integrally with rod receiver 64. Once pitch arm 62 is attached, it may be used to apply torque to torsion rod 56.

Figure 6:
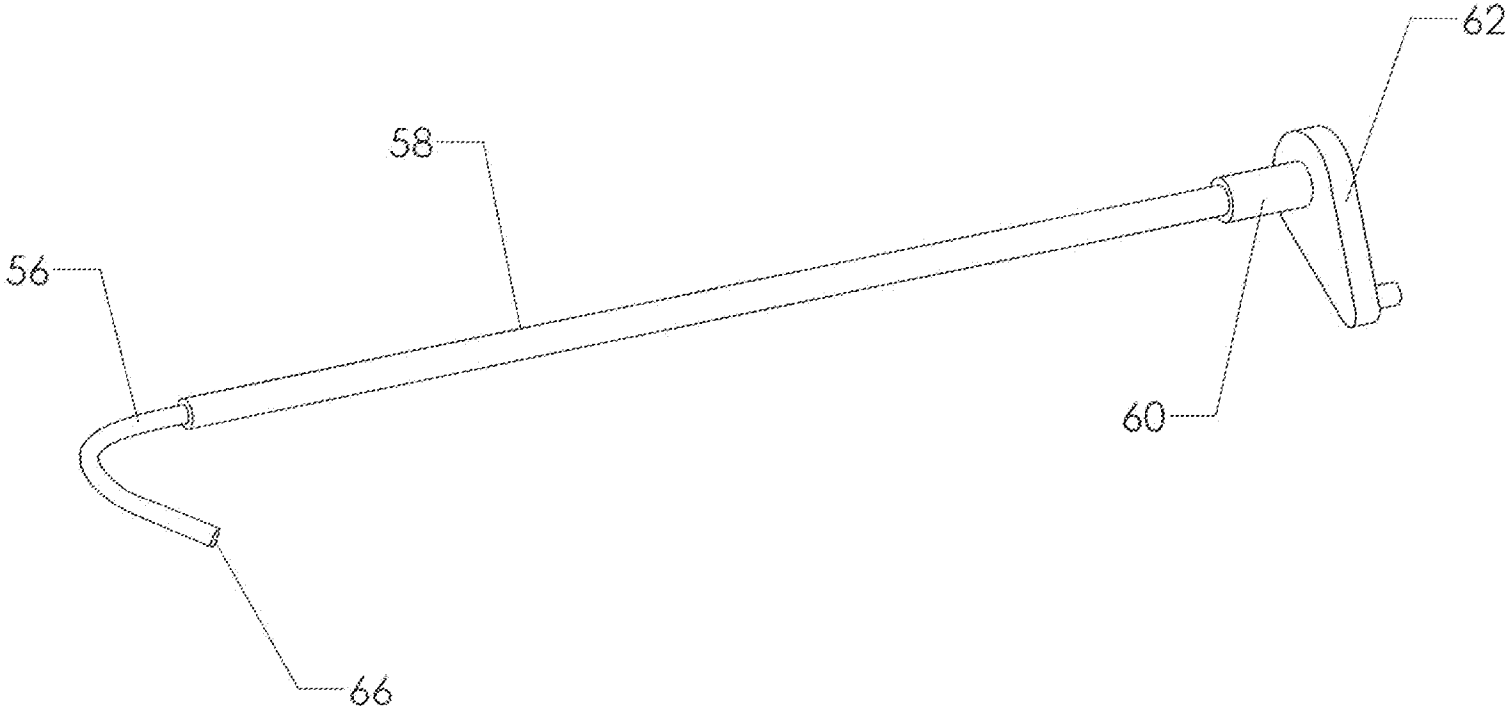
FIG. 6 is a perspective view, showing the torsional actuator in an assembled state.

FIG. 6 shows the torsional actuator in an assembled state. The portion of torsion rod 56 lying within sleeve 58 (the middle portion) and the portion lying within hub bearing 60 (the proximal portion are free to rotate with respect to both the sleeve and the hub bearing. Thus, the sleeve and hub bearing can remain fixed while rotating pitch arm 62 and torsion rod 56. Rotating the torsion rod tends to translate the position of rod tip 66 (through an arc).

Figure 7:
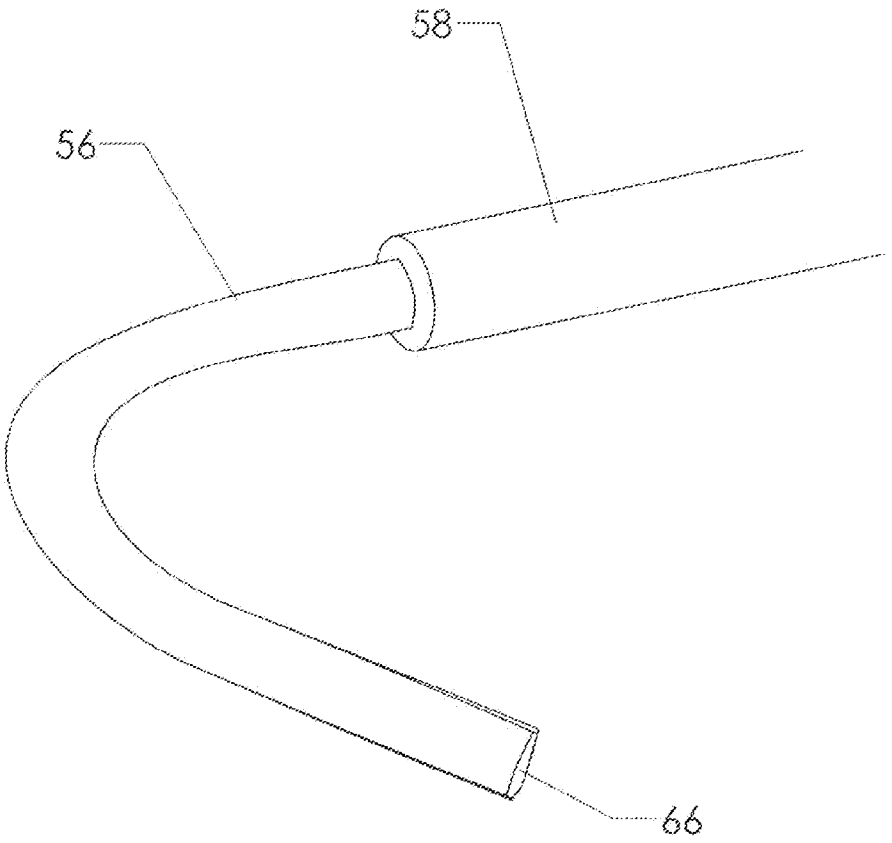
FIG. 7 is a detail view, showing the tip portion of the torsional actuator.

FIG. 7 shows a detailed view of the distal end of the torsion rod, including rod tip 66. Most of the torsion rod is cylindrical so that it can freely rotate within the sleeve and bearing. However, the cylindrical shape is preferably flattened into an oval for the portion of the rod extending out the distal end of sleeve 58.

Figure 8:
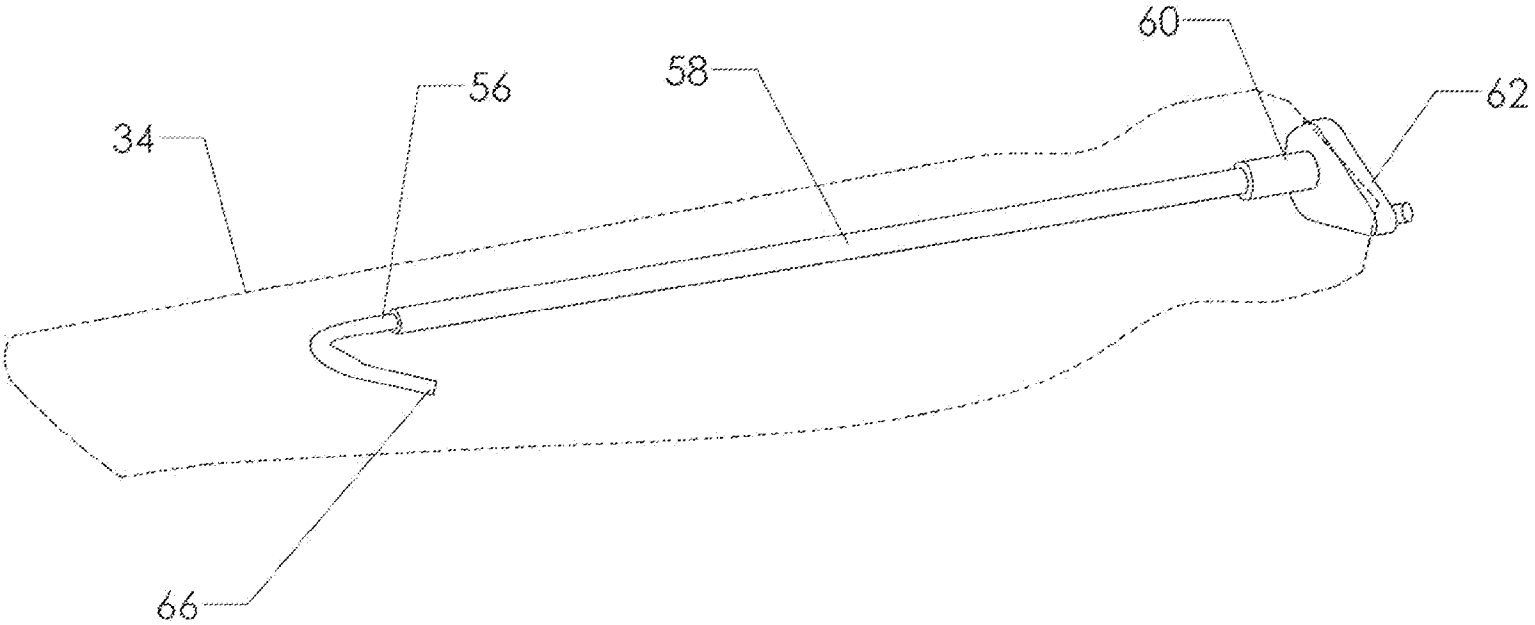
FIG. 8 is a perspective view, showing the position of a torsional actuator in a vane.

FIG. 8 shows the torsional actuator in the position it occupies within vane 34. Vane 34 may be made of a wide variety of materials assembled in many different ways. As an example, it may be created as a fiber-reinforced core matrix with a stiff exterior layer. The exterior layer may be made of woven carbon fiber. The torsional actuator is preferably laid into the composite structure as the composite structure is created. Sleeve 58 and hub bearing 60 may be bonded to the composite core material. Rod tip 66 preferably is bonded to the core material (and possibly part of the outer layer of material if it extends outward far enough).

Pitch arm 62 lies outside of vane 34 at the vane's proximal end. It is preferable to secure the vane's hub interface rigidly to the hub so that the hub interface itself does not twist significantly. Those skilled in the art will realize that a torque applied to pitch arm 62 will be transmitted via torsion rod 56 to the bent portion of the torsion rod lying distal to the distal end of sleeve 58. Sleeve 58 and hub bearing 60 will not rotate. However, rod tip 66 (and the bent portion of the rod in its vicinity) will rotate as pitch arm 62 is rotated. This rotation will twist a portion of vane 34. Thus, in this case, pitch arm 62 provides a torque input interface—meaning that it provides a mechanism for an external force to apply a torque to the torsional actuator. As will be explained, many different types of torque input interface can be provided.

Figure 9:
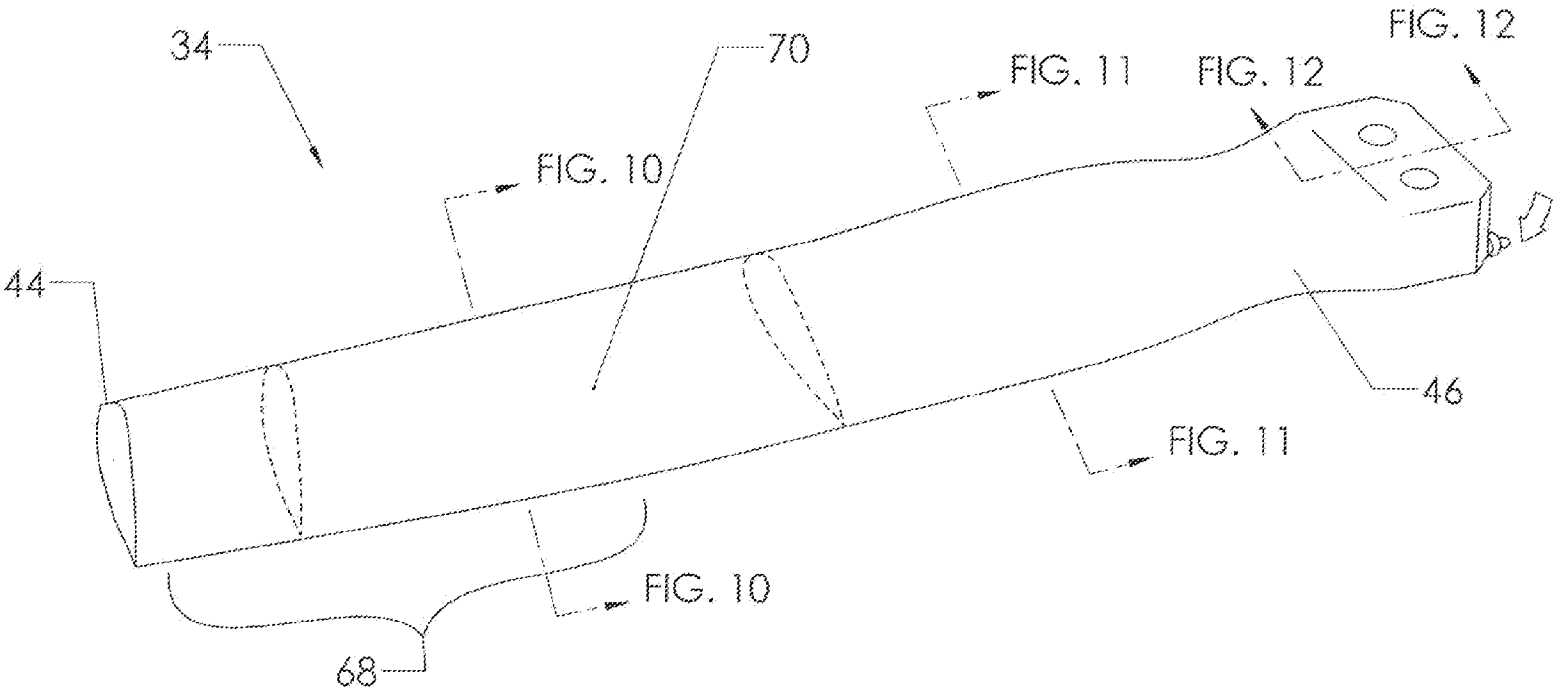
FIG. 9 is a perspective view, showing some details of a vane.

FIG. 9 shows vane 34 with the torsional actuator installed. Applying a torque to the pitch arm as indicated by the arrow increases the pitch of the vane in variable pitch region 68. Some twist will be experienced for most of the vane's length. However, the vane is made thicker and stiffer between middle region 70 and root 46. Thus, that portion of the vane will not tend to twist as much. Additional twist will of course not be added beyond the distal extreme of the torsion rod. As a result, most of the variable twist occurs within variable pitch region 68.

Figure 10:
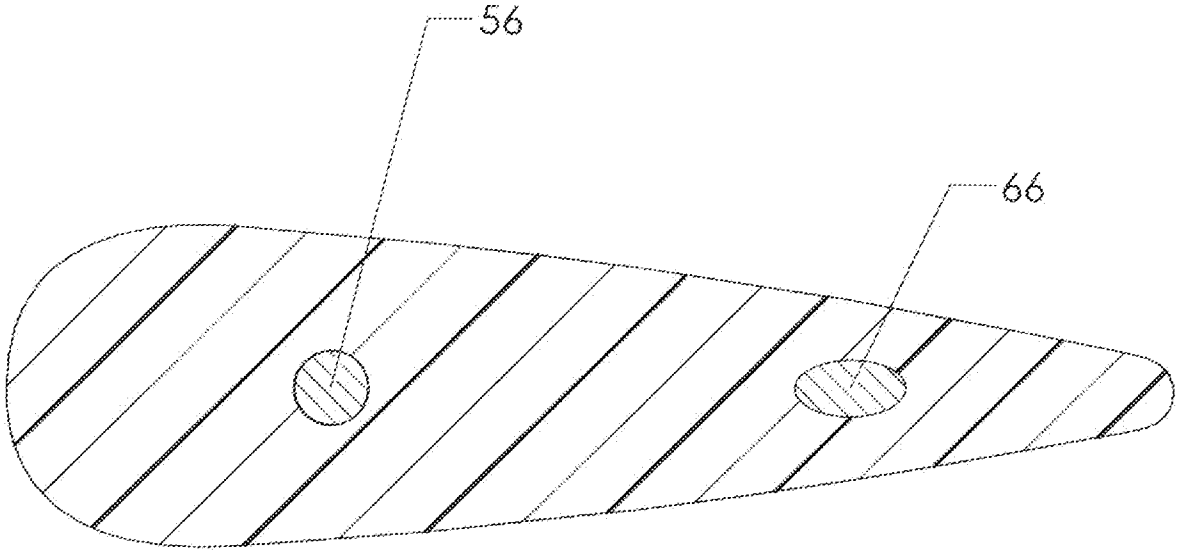
FIG. 10 is a sectional view, showing internal details of a vane.

FIG. 10 shows a section through the vane assembly where the bend in the torsion rod lies. The rod is embedded within the core material of the vane and is thereby mechanically locked to the vane in this region (Note how the flattened portion of rod tip 66 allows it to fit more easily within the vane's trailing edge).

Figure 11:
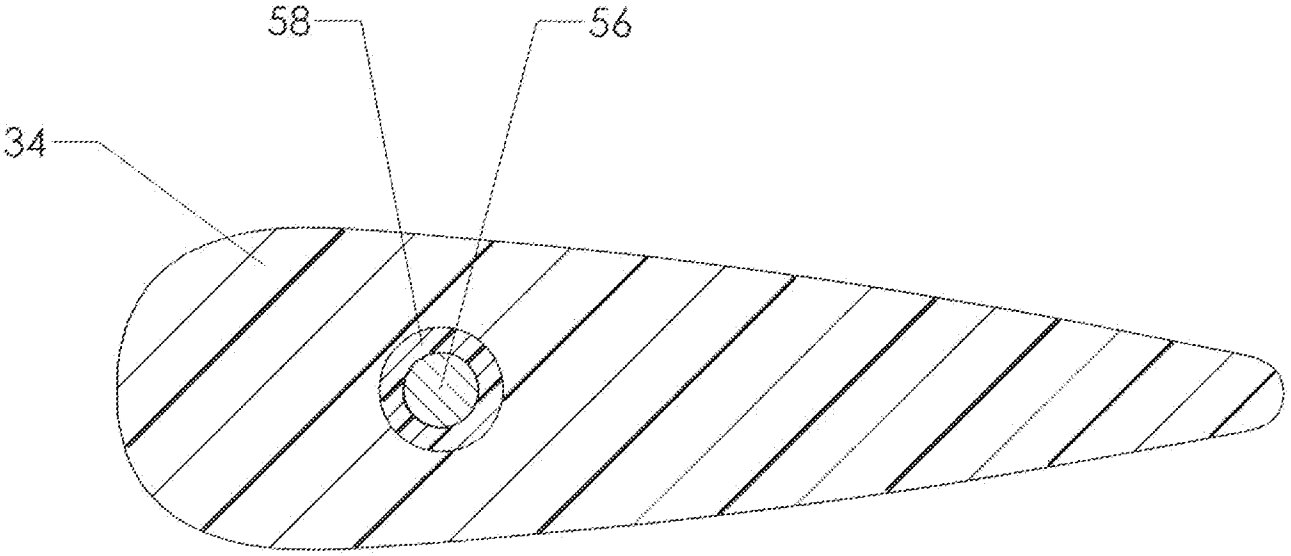
FIG. 11 is a sectional view, showing internal details of a vane.

FIG. 11 shows a section through the same assembly in the region of sleeve 58. In this region sleeve 58 is likely bonded to the core material of the vane but the torsion rod—being shielded by the sleeve—is not. Thus, the rotation of the torsion rod in this region will not impart any twisting force to the vane. The reader will thereby understand that the position and length of sleeve 58 helps to determine where the twisting force imparted by the torsion rod will actually be applied to the vane.

Figure 12:
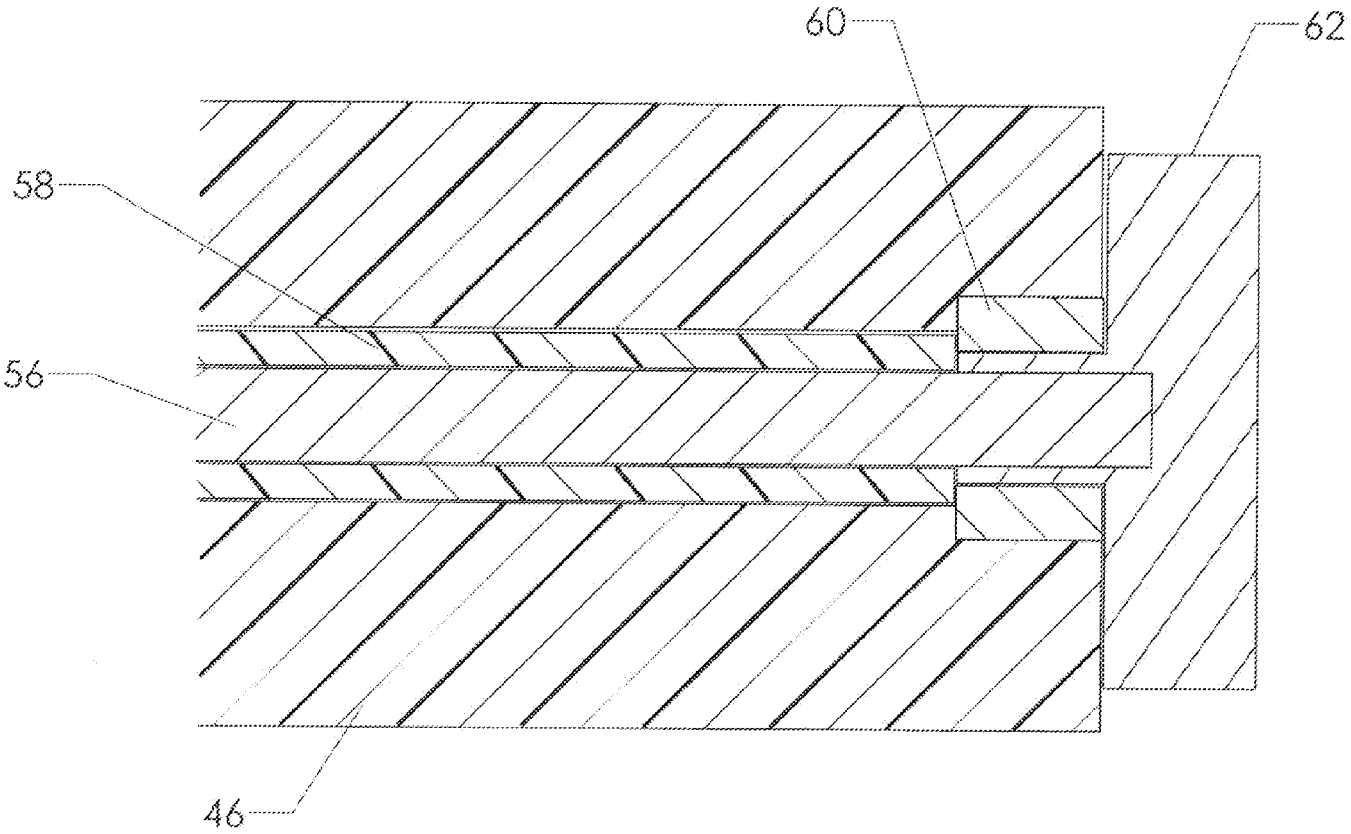
FIG. 12 is a sectional detail view, showing portions of the torsional actuator.

FIG. 12 shows a transverse section through the vane in the region of the hub interface (see the section "call out" in FIG. 9). Those skilled in the art will realize that the actuation of pitch arm 62 can produce significant reaction forces where torsion rod 56 enters the vane. In order to resist wear in this vicinity, a durable hub bearing 60 is preferably used. Sleeve 58 will experience significantly lower reaction forces. A polymer such as extruded NYLON may be used for this component.

Figure 13:
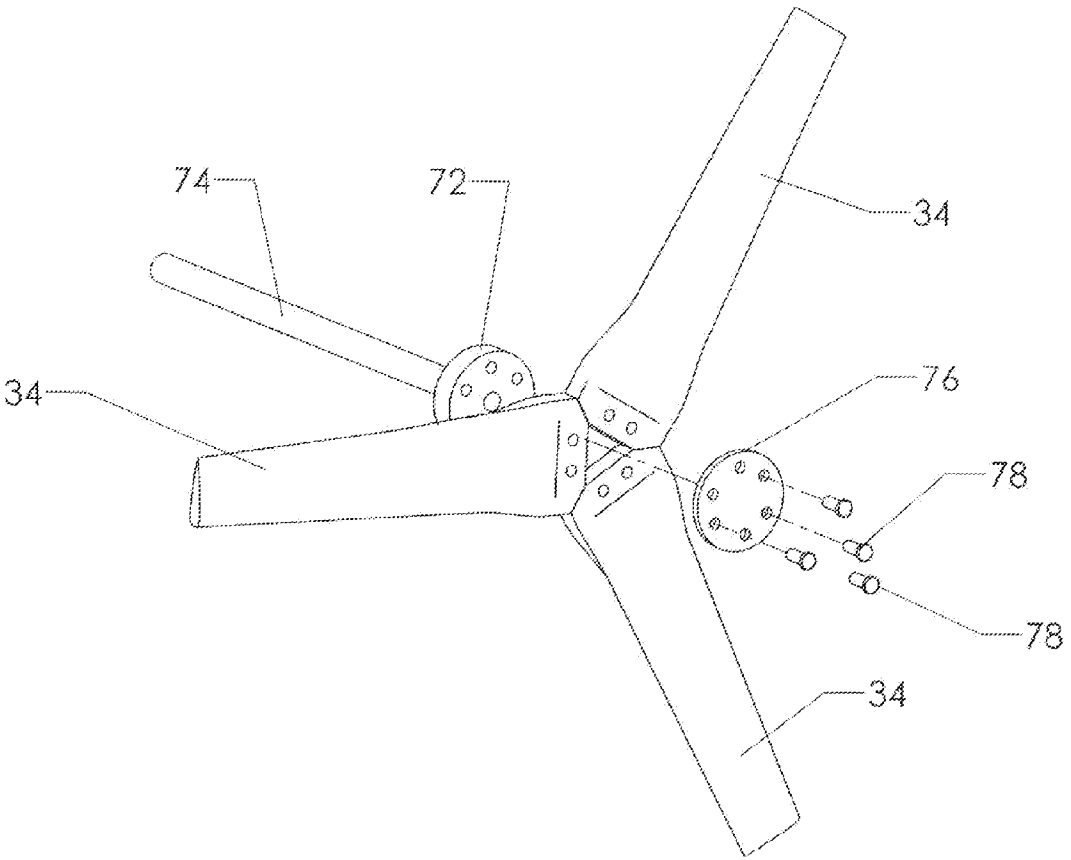
FIG. 13 is an exploded perspective view, showing an assembly of three vanes and a hub.

Having now described some of the component in significant detail, the reader may wish to known how an assembly comprising the present invention can be created. FIG. 13 shows an exemplary assembly. Two or more vanes are preferably included in order to create a balanced rotating mass. In the embodiment shown, three vanes 34 are used.

Drive shaft 74 provides rotational power to hub assembly 72. Both the drive shaft and hub assembly rotate about a central axis of rotation centered on the drive shaft. Each of the three vanes 34 is attached to hub assembly 72. The attachment can be made using many different devices but in the example shown several bolts 78 are passed through center disk 76, through the bolt holes in the vanes themselves, and into threaded holes in the hub assembly.

Figure 14:
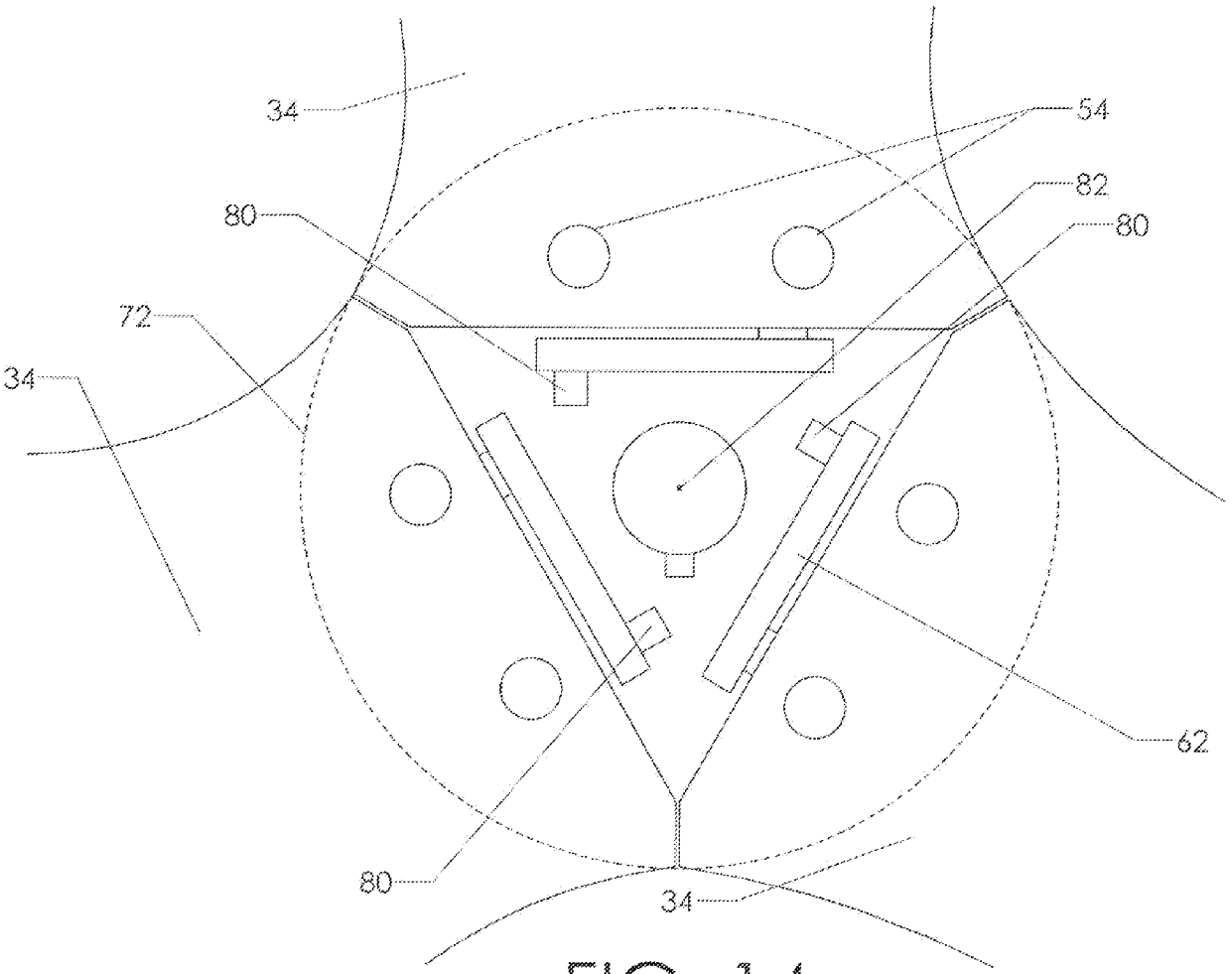
FIG. 14 is a plan view, showing three vanes attached to a hub.

FIG. 14 shows a detailed plan view of the area of the hub with the three vanes 34 in place and ready to be attached to the hub 72. The hub assembly in this example includes the mechanism for applying force to the torsional actuator in each vane (in order to selectively vary the pitch of each vane). The exemplary mechanism is somewhat simplistic and is only intended to represent one example of the type of actuating mechanisms that are possible.

A pitch arm 62 from each of the vanes lies within the hub. Each pitch arm 62 includes an actuator pin 80 which allows torque to be easily applied to the pitch arm by the actuating mechanism. Mounting holes 54 in each of the vanes align with threaded receivers in the hub assembly itself. Center bore 82 passes into the hub assembly.

Figure 15:
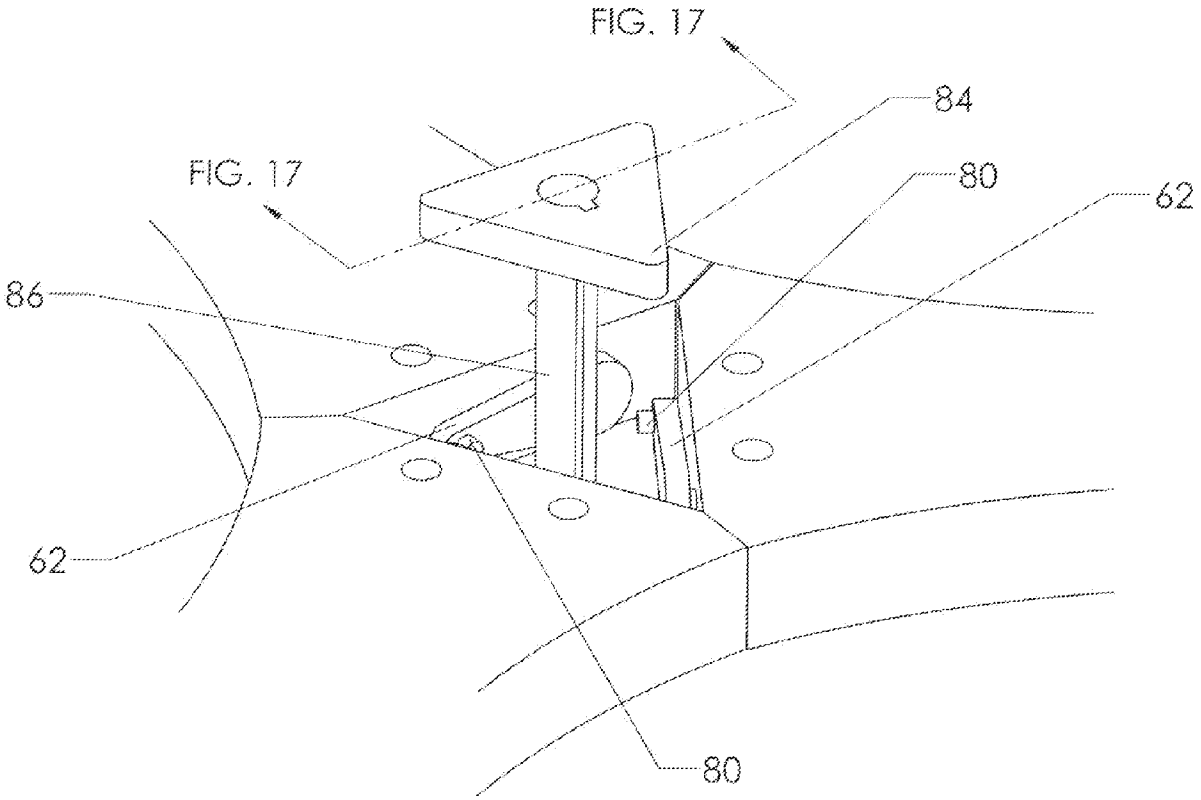
FIG. 15 is a perspective view, showing the hub of FIG. 14.

FIG. 15 shows a perspective view of the same general area. Actuator shaft 86 slides into center bore 82 in the hub assembly (The center bore is shown in FIG. 14). Actuator plate 84 is attached to the end of actuator shaft 86. Actuator shaft 86 is provided with a key protrusion that slides in a keyway provided in center bore 82 (see FIG. 14). The interface of the key protrusion and the keyway prevents the rotation of the actuator shaft and the attached actuator plate.

Actuator plate 84 is configured to bear against the three actuator pins 80 when actuator plate 84 is urged downward (in the orientation shown in the view). The actuator plate is intended to contact the actuator pins, but not the pitch arms themselves. This objective explains why the rotation of the actuator plate needs to be limited. If the actuator plate is allowed to rotate an interference would likely result.

Figure 16:
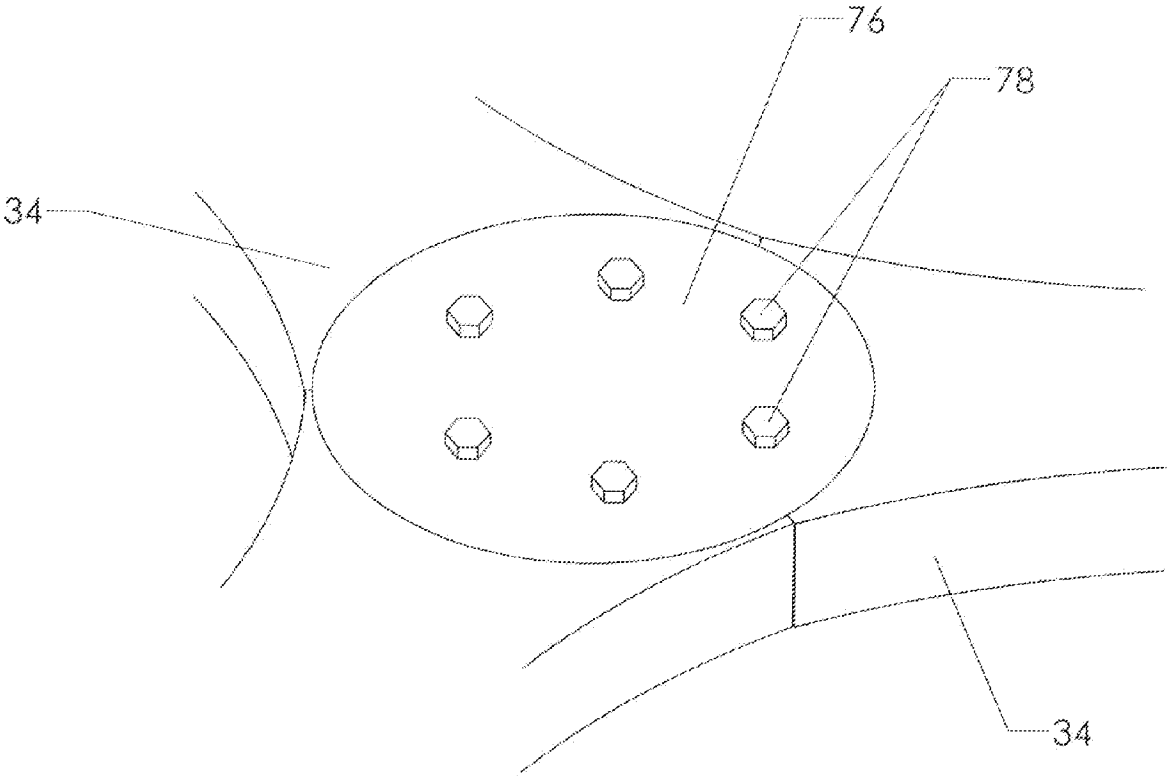
FIG. 16 is a perspective view, showing the hub of FIG. 14.

The configuration shown in FIG. 15 represents the position of the actuator plate before assembly is complete. Once the assembly is completed, actuator plate 84 preferably rests directly on the three actuator pins 80—thereby eliminating "backlash" in the system. FIG. 16 shows the final stage of the assembly. Center disk 76 is placed over the top of the three vanes and bolts 78 are passed through center disk 76, through the bolt holes in the vanes themselves, and into the hub. The reader will thereby appreciate that the portion of each vane actually attached to the hub is attached in a rigid fashion. Though the present invention is actually intended to twist the vanes in order to provide the desired pitch variation, the portion of each vane proximate the hub will not experience much twist.

Figure 17:
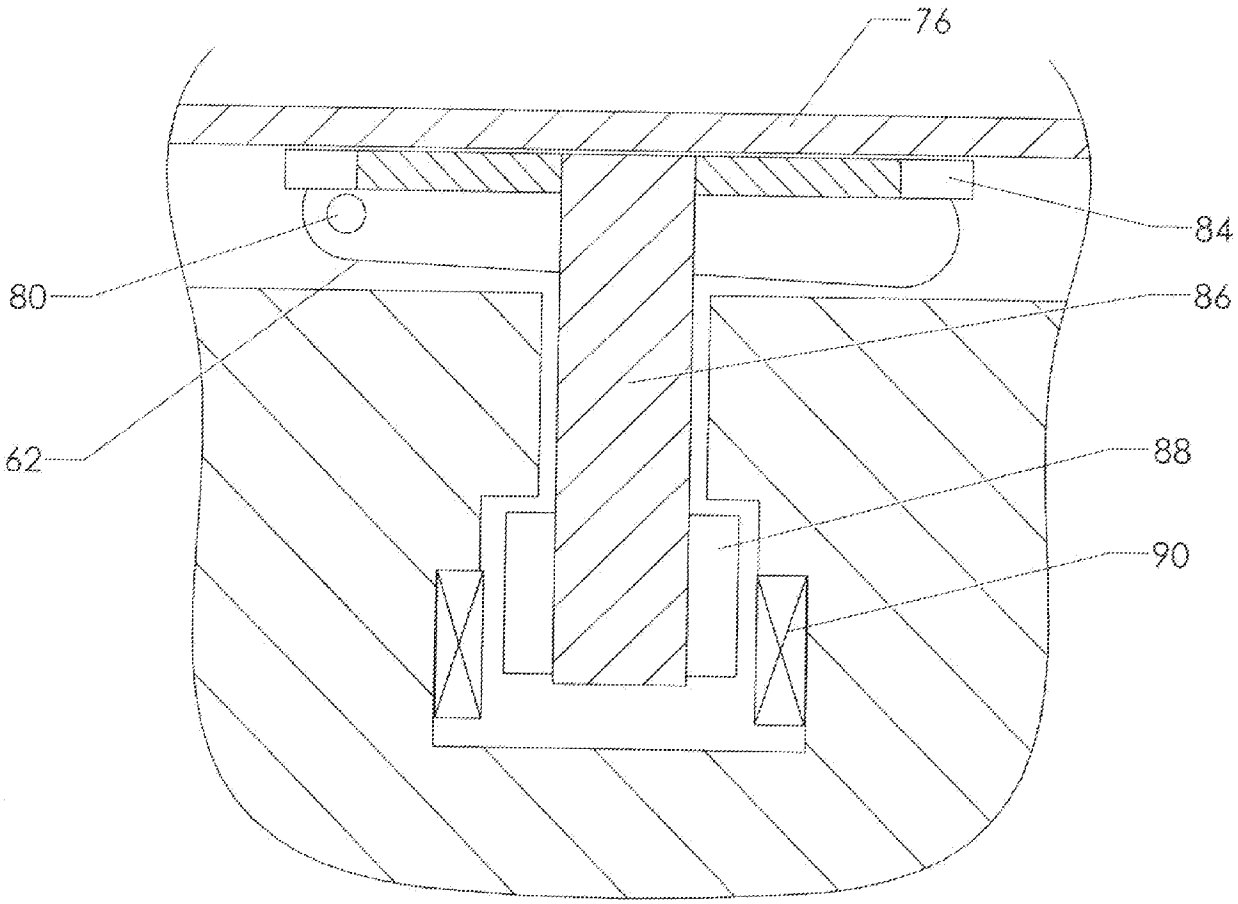
FIG. 17 is a sectional elevation view, showing a representative actuating mechanism.
Figure 18:
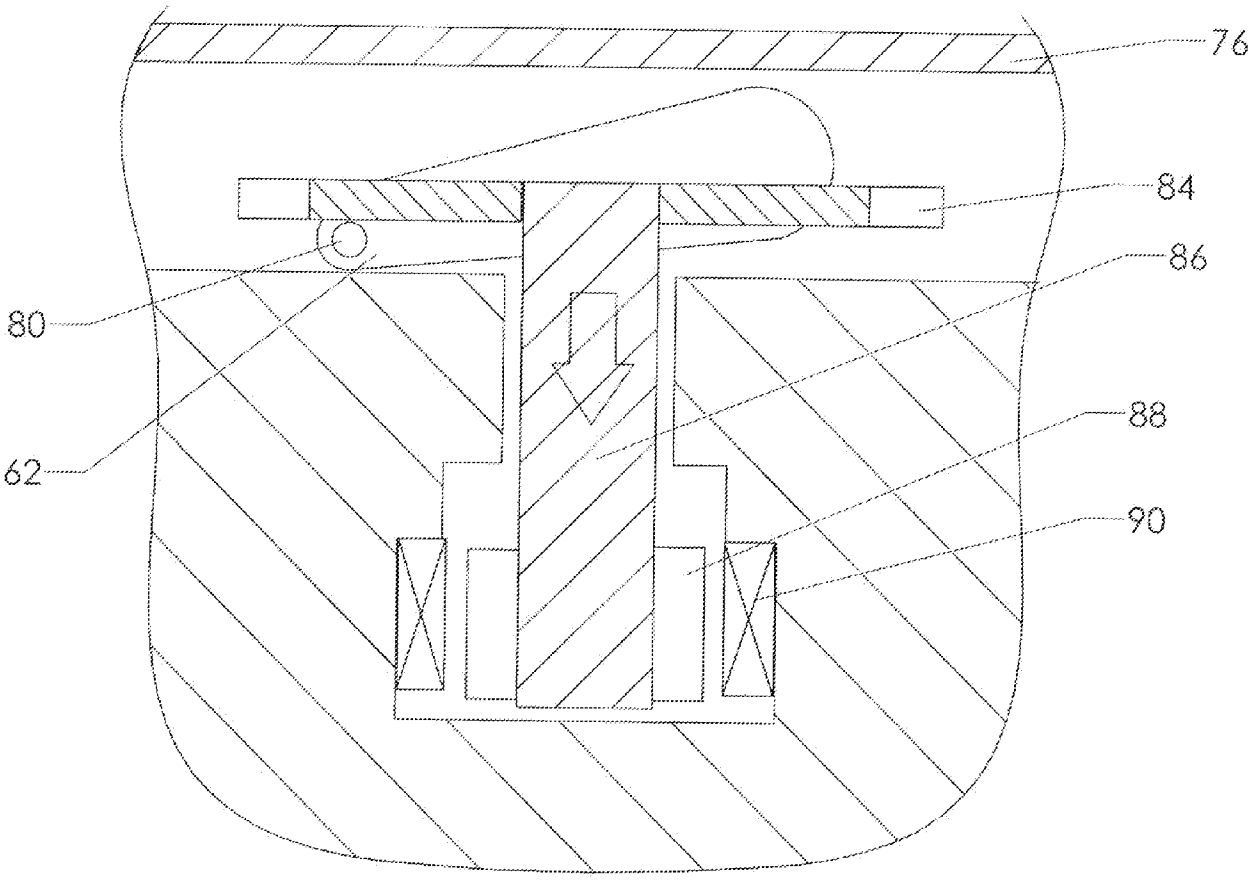
FIG. 18 is a sectional elevation view, showing a representative actuating mechanism.

FIGS. 17 and 18 illustrate the operation of the exemplary pitch-actuating mechanism. FIG. 17 is a section view taken through the center of actuator shaft 86 (The plane of the section view is called out in FIG. 15). FIG. 17 represents the "neutral" position in which no (or very little) torque is placed on the torsional actuator in each vane (It is optional to maintain a low pre-load torque in some instances). Actuator plate 84 rests against actuator pin 80 on the pitch arm 62 shown.

Actuator plate 84 is—as explained previously—attached to the outer end of actuator shaft 86. The inner end of actuator shaft 86 forms part of a linear actuator. Magnet 86 is attached to the inner end of the actuator shaft. Electromagnetic actuator 90 is attached to the hub and stays in place.

When the electromagnetic actuator is activated, actuator shaft 86 is pulled into the hub (downward in the orientation of the view). FIG. 18 shows this position. Actuator shaft 86 moves in the direction indicated by the arrow. Actuator plate 84 bears against actuator pin 80 and pulls it downward as shown. This motion rotates pitch arm 62 and thereby applies torque to the torsional actuator in the vane. The result is a change in the pitch of the vane.

Although only one pitch arm is visible in the section view of FIG. 18, the motion of actuator plate 84 simultaneously moves all three pitch arms in this embodiment. Thus, the pitch of all three vanes is varied simultaneously.

Electromagnetic actuator 90 should not be viewed as an "on/off" device. Rather, it is preferably a device that is able to smoothly provide any desired amount of linear force within a defined range in either direction. For example, if the electrical power signal fed into electromagnetic actuator 90 is a 200 Hz sinusoidal signal, the actuator will move the actuator shaft sinusoidally tracking the phase and amplitude of the signal.

Electromagnetic actuator 90 may be capable of producing linear force in both directions and also the restoring force. On the other hand, the stiffness of the vanes will tend to rapidly return the assembly to the "neutral" position (FIG. 17) once the force is removed. Thus, the actuator may be configured to apply force in only one direction and allow the stiffness of the vanes to act as a restoration force for aerodynamic stability. Even if force is applied in both directions, the vane stiffness is helpful in impedance matching.

Returning now to FIG. 8, the reader will recall that each vane includes a torsional actuator embedded within a naturally stiff structure. The resonant frequency of the vane itself is preferably fairly high. Exemplary blades using carbon fiber may have a torsional resonant frequency above 2,000 Hz. The inherent stiffness of the structure means two things. First, frequencies below the resonant frequency may be applied to the vanes by the twisting mechanism without fear of exciting a resonant frequency or blade bending or flap mode that possibly creates aerodynamic flutter. Thus, the vanes may be excited by input frequencies over a very wide range (lower than 20 Hz and up to the vicinity of 2,000 Hz for a structure having resonance above 2,000 Hz). Second, the vanes are able to respond to the relatively high-frequency input signal phase and amplitude without substantial distortion or reductions in the amplitude of the output. Third, the vanes become easy to twist near the torsional natural frequency which reduces the effects of inertia and increases the high frequency output.

This latter phenomenon represents one of the significant features of the present invention. The proposed structure:

(1) Adjusts pitch on the faster traveling part of the vane, thereby imparting a more forceful pressure variation;

(2) Avoids having to change the pitch of the entire vane, thereby avoiding significant polar moment of inertia delays; and (3) Uses the structural stiffness of the vane itself as a restoring force to improve high frequency output.

The linear actuating mechanism shown in FIGS. 17 and 18 is rather simplistic. Additional features could be substituted or added, including:

(1) Using hydraulic power to drive the linear actuator rather than electromagnetic power;

(2) Locating the actuator pins 80 in a slot in actuator plate 84 so that the linear actuator could drive the actuator pins in both directions;

(3) Including a roller bearing on each actuator pin to minimize friction;

(4) Using a purely mechanical device for driving the linear actuator, such as a moving cam; and (5) Locating the actuating mechanism outside the hub, such as out near the vane tips.

As explained previously, the neutral position of the vanes need not be a zero-thrust state. The embodiments depicted all produce some thrust in the neutral position (though this need not always be the case). Thus, it is possible to use the inventive rotary transducer as both a mass-moving device and a sound producing device. Depending upon the desired output, one may even configure the input signal that produces the vane twisting to reduce the amount of sound produced by the rotating assembly.

Figure 19:
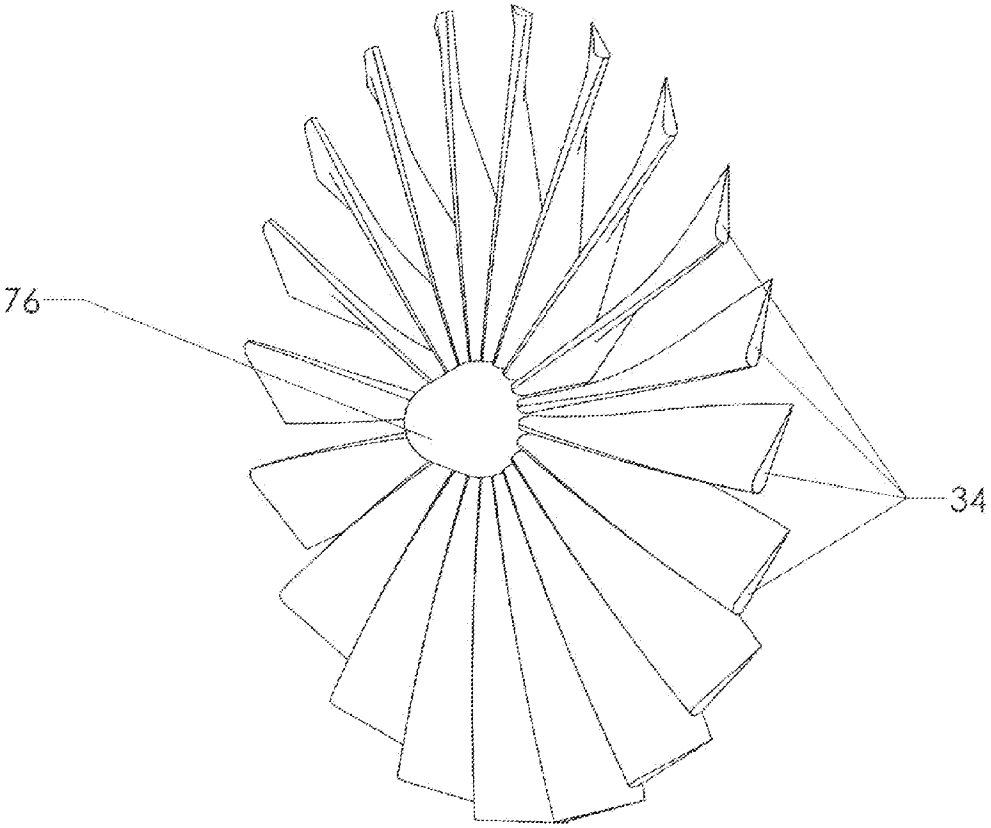
FIG. 19 is another embodiment using more than three vanes.

Although an example provided has used only three vanes, the reader should bear in mind that the invention may be implemented using four, five, or even more vanes. FIG. 19 shows an embodiment using many more vanes. The functional operation of the embodiment of FIG. 19 is the same. The vanes still include a torsional actuator. However, many more vanes are involved. Additional variations on the invention are possible, including:

(1) Only varying the pitch on some of the vanes in a rotating assembly;

(2) Containing the rotating vanes within a duct to minimize tip losses or account for other phenomena;

(3) Placing the pitch varying mechanism near the outer perimeter of the vanes rather than the hub; and (4) Using more direct actuation methods—such as a magnet embedded in each vane responding to an electromagnetic force.

The preceding descriptions contain significant detail regarding the novel aspects of the present invention. They should not be construed, however, as limiting the scope of the invention but rather as providing illustrations of the preferred embodiments of the invention. Thus, the scope of the invention should be fixed by the following claims, rather than by the examples given.

Having described my invention, I claim:

1. A method for transforming cyclical input energy into sound, comprising:

a. providing a hub;

b. providing a plurality of vanes, each vane including, i. a hub interface connected to said hub, ii. a root extending outward from said hub interface, iii. a middle region extending outward from said root, iv. a variable pitch region extending outward from said middle region, v. a torsional actuator configured to twist said variable pitch region, said torsional actuator including a torque input interface proximate said hub interface;

c. providing a mechanical transducer configured to transmit said cyclical input energy to torque applied at said torque input interface on said vanes;

d. rotating said hub, thereby rotating said plurality of vanes; and e. while said hub is rotating, applying said cyclical input energy to said mechanical transducer, thereby cyclically twisting said vanes and producing sound.

2. A method for transforming cyclical input energy into sound as recited in claim 1, wherein said torsional actuator for each of said vanes comprises:

a. a torsion rod lying within said vane having a proximal end, a middle region, and a distal tip;

b. said distal end of said torsion rod being embedded within said variable pitch region of said vane;

c. said proximal end and middle region of said torsion rod being free to rotate with respect to said vane; and d. said torque input interface being located on said proximal end of said vane.

3. A method for transforming cyclical input energy into sound as recited in claim 2 wherein said middle region of said torsion rod is enclosed within a sleeve and said middle portion of said rod is free to rotate with respect to said sleeve.

4. A method for transforming cyclical input energy into sound as recited in claim 2 wherein said torque input interface comprises:

a. a pitch arm connected to said proximal end of said torsion rod; and b. a linear actuator positioned to engage said pitch arm so that linear motion of said linear actuator rotates said pitch arm, thereby applying torque to said torsion rod.

5. A method for transforming cyclical input energy into sound as recited in claim 4, wherein said linear actuator is moved by electromagnetic force.

6. A method for transforming cyclical input energy into sound as recited in claim 4, wherein said linear actuator is moved by hydraulic force.

7. A method for transforming cyclical input energy into sound as recited in claim 4, wherein a single linear actuator simultaneously engages all pitch arms on all vanes.

8. A method for creating sound, comprising:

a. providing a plurality of vanes arrayed around a central axis of rotation, each vane including, i. a hub interface proximate said central axis of rotation, ii. a root extending outward from said hub interface, iii. a middle region extending outward from said root, iv. a variable pitch region extending outward from said middle region, v. a torsional actuator configured to twist said variable pitch region, said torsional actuator including a torque input interface proximate said hub interface;

b. rotating said vanes about said central axis of rotation; and c. while said vanes are rotating, cyclically applying torque to said torque input interface on each of said vanes, thereby cyclically twisting said vanes and creating said sound.

9. A method for transforming cyclical input energy into sound as recited in claim 8, wherein said torsional actuator for each of said vanes comprises:

a. a torsion rod lying within said vane having a proximal end, a middle region, and a distal tip;

b. said distal end of said torsion rod being embedded within said variable pitch region of said vane;

c. said proximal end and middle region of said torsion rod being free to rotate with respect to said vane; and d. said torque input interface being located on said proximal end of said vane.

10. A method for transforming cyclical input energy into sound as recited in claim 8 wherein said middle region of said torsion rod is enclosed within a sleeve and said middle portion of said rod is free to rotate with respect to said sleeve.

11. A method for transforming cyclical input energy into sound as recited in claim 9 wherein said torque input interface comprises:

a. a pitch arm connected to said proximal end of said torsion rod; and b. a linear actuator positioned to engage said pitch arm so that linear motion of said linear actuator rotates said pitch arm, thereby applying torque to said torsion rod.

12. A method for transforming cyclical input energy into sound as recited in claim 11, wherein said linear actuator is moved by electromagnetic force.

13. A method for transforming cyclical input energy into sound as recited in claim 1, wherein said linear actuator is moved by hydraulic force.

14. A method for transforming cyclical input energy into sound as recited in claim 11, wherein a single linear actuator simultaneously engages all pitch arms on all vanes.

15. A method for creating sound, comprising:

a. providing a plurality of vanes connected to a hub, each vane including,
   i. a hub interface rigidly connected to said hub,
   ii. a root extending outward from said hub interface,
   iii. a middle region extending outward from said root,
   iv. a variable pitch region extending outward from said middle region,
   v. a torsional actuator passing through said vane from said hub interface to said variable pitch region, said torsional actuator being configured to twist said variable pitch region and including a torque input interface proximate said hub interface;

b. rotating said hub thereby rotating said vanes; and c. while said vanes are rotating, cyclically applying torque to said torque input interface on each of said vanes, thereby cyclically twisting said vanes and creating said sound.

16. A method for transforming cyclical input energy into sound as recited in claim 15, wherein said torsional actuator for each of said vanes comprises:

a. a torsion rod lying within said vane having a proximal end, a middle region, and a distal tip;

b. said distal end of said torsion rod being embedded within said variable pitch region of said vane;

c. said proximal end and middle region of said torsion rod being free to rotate with respect to said vane; and d. said torque input interface being located on said proximal end of said vane.

17. A method for transforming cyclical input energy into sound as recited in claim 16 wherein said middle region of said torsion rod is enclosed within a sleeve and said middle portion of said rod is free to rotate with respect to said sleeve.

18. A method for transforming cyclical input energy into sound as recited in claim 16 wherein said torque input interface comprises:

a. a pitch arm connected to said proximal end of said torsion rod; and b. a linear actuator positioned to engage said pitch arm so that linear motion of said linear actuator rotates said pitch arm, thereby applying torque to said torsion rod.

19. A method for transforming cyclical input energy into sound as recited in claim 18, wherein said linear actuator is moved by electromagnetic force.

20. A method for transforming cyclical input energy into sound as recited in claim 18, wherein said linear actuator is moved by hydraulic force.

* * * * *